United States Patent [19]

Vogel et al.

[11] Patent Number: 4,795,697

[45] Date of Patent: Jan. 3, 1989

[54] STABILIZATION OF KETAZINE DYES

[75] Inventors: Kim M. Vogel; David C. Weigel; Roger A. Mader, all of St. Paul, Minn.

[73] Assignee: Minnesota Mining and Manufacturing Company, St. Paul, Minn.

[21] Appl. No.: 946,970

[22] Filed: Dec. 29, 1986

[51] Int. Cl.[4] ..... G03C 1/40

[52] U.S. Cl. ..... 430/619; 430/620; 430/351; 430/964; 430/559; 430/562

[58] Field of Search ..... 430/617, 619, 620, 351, 430/559, 562, 964

[56] References Cited

U.S. PATENT DOCUMENTS

| | | | |
|---|---|---|---|
| 4,370,401 | 1/1983 | Winslow et al. | 430/178 |
| 4,374,921 | 2/1983 | Frenchik | 430/338 |
| 4,585,734 | 4/1986 | Weigel | 430/620 |
| 4,587,211 | 5/1986 | Ishida et al. | 430/617 |
| 4,594,307 | 6/1986 | Ishida | 430/203 |

OTHER PUBLICATIONS

Research Disclosure Statement, vol. 125, pp. 25–26, Sept. 1974, Item 12533.

*Primary Examiner*—Won H. Louie

*Attorney, Agent, or Firm*—Donald M. Sell; Mark A. Litman

[57] ABSTRACT

Alkyl ketazine dyes are stabilized by the presence of poly(vinyl chloride) and/or poly(vinylidene chloride) binders in photothermographic emulsions.

20 Claims, No Drawings

STABILIZATION OF KETAZINE DYES

BACKGROUND OF THE INVENTION

1. Field of the Invention

The present invention relates to dry silver photothermographic imaging materials and to stabilizers for alkyl ketazine leuco dyes used in color photothermographic imaging systems.

2. Prior Art

Photosensitive, heat-developable, dry silver sheet materials, as described for example in U.S. Pat. Nos. 3,457,075 and 3,839,049, contain a photosensitive silver halide catalyst-forming means in catalytic proximity with a heat sensitive combination of a light stable organic silver compound and a reducing agent therefor. When struck by light, the silver halide catalyst-forming means produces silver nuclei which serve to catalyze the reduction of the organic silver compound, e.g., silver behenate, by the reducing agent at elevated temperatures. To improve the image density and color it has been found desirable to iinclude toners in the sheet construction.

Color photothermographic imaging systems have been described in patent literature. U.S. Pat. No. 3,531,286 describes a system using paraphenylenediamine and photographic color couplers. U.S. Pat. No. 3,985,565 discloses the use of phenolic leuco dye reducing agents to reduce the silver and provide a color image. U.S. Pat. No. 4,460,681 discloses a multilayer color photothermographic system using a variety of leuco dyes separated by barrier layers.

U.S. Pat. No. 4,587,211 describes the use of poly(vinyl chloride) and poly(vinylidene chloride) polymers as stabilizers for the dye image formed by oxidation of syringaldazine leuco dyes.

BRIEF DESCRIPTION OF THE INVENTION

In accordance with the practice of the present invention, it has now been found possible to provide photosensitive, heat-developable, dry silver imaging sheets which give good, stable color images using leuco dyes which are derivatives of ketazines. The dyes may be further stabilized by the addition of stabilizers which are resins which comprise poly(vinyl chloride) and/or poly(vinylidene chloride).

DETAILED DESCRIPTION OF THE INVENTION

In order to provide a full spectrum of color in the final image of a color photothermographic element, a wide variety of leuco dyes providing different final colors should be available. Many leuco dyes tend to be highly sensitive to the active environment of a photothermographic emulsion. This sensitivity can occur either to the leuco dye or to the dye generated by oxidation of the leuco dye.

Certain leuco dye derivatives of syringaldazine provide useful dye colors upon oxidation, but the dyes are rapidly bleached in the photothermographic system. The dyes of particular importance are 4-hydroxy-3,5-dialkoxybenzaldehyde azines. The preferred dyes are where the alkoxy groups are 3,5-diethoxy or 3,5-dimethoxy. These leuco dyes produce useful colors upon oxidation, but are readily bleached by the photothermographic emulsion. The synthesis of syringaldazines is taught in "Use of Syringaldazine in a Photometric Method for Estimating 'Free' Chlorine in Water", R. Bauer et al., Analytical Chemistry, Vol. 43, No. 3, March 1971, and is commercially available. These dyes are reported also in U.S. Pat. No. 4,587,211.

A novel class of ketazine leuco dyes has been found which by themselves provide substantially increased stability for the visible dyes formed by their oxidation. These novel dyes and closely related dyes may be further stabilized by their association with a visible dye image stabilized amount of a resin selected from the group consisting of poly(vinyl chloride), poly(vinylidene chloride), and copolymers thereof.

Syringaldazine leuco dyes have the common nucleus

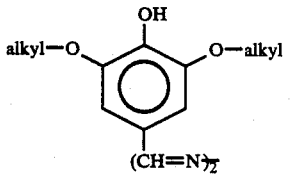

I

While ketazine leuco dyes have the common nucleus

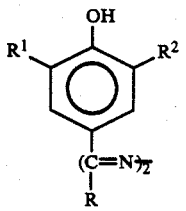

II wherein R is an alkyl, alkylaryl, or alkylcycloalkyl group. According to the present invention, ketazines wherein R is an alkyl group of at least four (4) carbon atoms, an alkylaryl group with up to 6 carbon atoms in the alkyl group, and alkylcycloalkyl with 1 to 6 carbon atoms in the alkyl and 5 or 6 carbon atoms in the cycloalkyl group provides dyes with increased light and storage stability over syringaldazines and ketazines wherein R is alkyl of 1 to 3 carbon atoms. R may have as many as 20 carbon atoms, but the number of carbon atoms is preferably equal to or less than 12.

The use of the stabilizing polymers is effective in providing increased stability for ketazines wherein the number of carbon atoms in R is at least 2.

Groups $R^1$ and $R^2$ may be H (with no more than one of $R^1$ and $R^2$ equal to H), alkyl (preferably of 1 to 6 carbon atoms), alkoxy (preferably 1 to 6 carbon atoms), aryl (preferably up to 14 carbon atoms, e.g., phenyl, naphthyl, anthryl), and heterocyclic rings (preferably 5- or 6-membered rings having ring atoms of C, N, S, O or Se, with no more than 14 atoms in the heterocyclic ring group other than H).

It has been found that the addition of a class of resins to the emulsion helps to stabilize the color image produced by the syringaldazine leuco dyes. The addition of a stabilizing amount of a polymer or copolymer of a resin comprising poly(vinyl chloride) and/or poly(vinylidene chloride) has been found to be useful in the present invention. By 'copolymer' it is meant that the polymer contains at least 25 molar percent of poly(vinyl chloride) and/or poly(vinylidene chloride) in the resin, the term being inclusive of terpolymers, block copolymers, etc. Specific resins which have been tried and found to be useful are homopolymers of poly(vinyl chloride) and poly(vinylidene chloride), copolymers of poly(vinyl chloride) and poly(vinylidene chloride), and copolymers of poly(vinyl chloride) with vinyl acetate and vinyl alcohol.

The amount of stabilizing resin material may be varied from one construction and formulation oo the next. It is therefore desirable to incorporate an effective amount of resin to produce the desired image stabilizing benefits. With the weak reducing agents or developers, such as the hindered phenols, a lesser amount of resin can be employed than with the stronger reducing agents, such as methyl gallate, hydroquinone and methoxy hydroxy naphthalene. Resin concentration will particularly vary with the proportion of syringaldazine leuco dyes as well as with the thickness of the coating and developing conditions, e.g., heat development time and temperature. Thus, for example, one construction may require a temperature of 260° F. (126° C.) with a dwell time of 3 seconds, while another may require 300° F. (147° C.) for 5 seconds, and still another may need 230° F. (110° C.) for 35 seconds, and the amount of stabilizing resin and type of reducing agent may be varied accordingly. In most constructions the concentrations of the active resin ingredient (the poly(vinyl chloride) or poly(vinylidene chloride)) will fall in the range of 0.25 to 50 times the weight of the leuco dye, preferably in the range of 0.40 to 40 times the weight of the leuco dye. The leuco dye is present in a transmission optical density of 0.5 upon oxidation of 100% of the dye. The leuco dye, expressed in other terms, may be present as from 0.05 to 10% by dry weight of the layer it is coated out in, preferably from 0.10 to 5% by dry weight of that layer.

Photothermographic dry silver emulsions are usually constructed as one or two layers on a substrate. Single layer constructions must contain the silver source material, the silver halide in catalytic proximity to said silver source material, the developer in reactive association with said silver source material, and binder as well as optional additional materials such as toners, coating aids and other adjuvants. Two-layer constructions must contain the silver source and silver halide in catalytic proximity in one emulsion layer (usually the layer adjacent the substrate) and some of the other ingredients in the second layer or both layers.

The terms catalytic proximity and reactive association are well known in the art. Catalytic proximity means that silver formed in the silver halide is in such physical proximity to the organic silver salt that it can act as a catalyst in the thermally activated reduction of the silver organic salt. Reactive association means that the color forming developer is in such physical proximity to the organic silver salt that upon thermal activation the developer can reduce the organic silver salt.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toner materials may also be present, for example, in amounts of from 0.2 to 10 percent by weight of all silver-bearing components. Toners are well known materials in the photothermographic art as shown by U.S. Pat. Nos. 3,080,254; 3,847,612 and 4,123,282.

The binder may be selected from any of the well-known natural and synthetic resins such as gelatin, polyvinyl acetals, polyvinyl acetate, cellulose acetate, polyolefins, polyesters, polystyrene, polyacrylonitrile, polycarbonates, and the like. Copolymers and terpolymers are of course included in these definitions. The polyvinyl acetals, such as polyvinyl butyral and polyvinyl formal, and vinyl copolymers such as polyvinyl acetate/chloride are particularly desirable. The binders are generally used in a range of from 20 to 75 percent by weight of each layer, and preferably about 30 to 55 percent by weight. The binder for the layer containing the syringaldazine leuco dye must of course comprise an effective amount of the stabilizing binder of the present invention.

For use on paper or other non-transparent backings it is found convenient to use silver half-soaps, of which an equimolar blend of silver behenate and behenic acid, prepared by precipitation from aqueous solution of the sodium salt of commercial behenic acid and analyzing about 14.5 percent silver, represents a preferred example. Transparent sheet materials made on transparent film backing require a transparent coating and for this purpose the ilver behenate full soap, containing not more than about four or five percent of free behenic acid and analyzing about 25.2 percent silver, may be used. Other components, such as coloring, opacifiers, extenders, spectral sensitizing dyes, etc. may be incorporated as required for various specific purposes. Antifoggants, such as mercuric salts and tetrachlorophthalic anhydride, may also be included in the formulation.

EXAMPLES 1-11

The following method was used in evaluating the stability of the dyes in the present invention. A standard photothermographic formulation was prepared comprising 127 g half-soap silver behenate
175 g toluene
12 ml $HgBr_2$/100ml methanol
56 g poly(vinyl butyral)

72 g 120 g poly(vinyl chloride/vinyl acetate, 80/20) copolymer, 240 g toluene, 240 g methylethylketone 2 ml 20% by weight methanol solutions of sensitizing dye To 50 g of this formulation is added 0.2 g of the dye to be tested. The mixture is first coated at 3 mils wet thickness and dried at 180° F. (81° C.). A top coat solution of poly(styrene) in toluene and acetone (50/50) with 0.2 g of phthalazinone per 50 g of solution was overcoated on the dried first coating at 3 mils wet thickness and dried at 81° C.

The dyes used in the examples are described according to the structural formula II shown above

| Dye | R | $R^1$ | $R^2$ |
|---|---|---|---|
| A | H | $OCH_3$ | $OCH_3$ |
| B | H | t-butyl | t-butyl |
| 1 | $-CH_2CH_3$ | t-butyl | t-butyl |
| 2 | $-(CH_2)_3CH_3$ | t-butyl | t-butyl |
| 3 | $-CH_2CH_3$ | $OCH_3$ | $OCH_3$ |
| 4 | $-CH_2CH(CH_3)_2$ | $OCH_3$ | $OCH_3$ |
| 5 | $-(CH_2)_8CH_3$ | $OCH_3$ | $OCH_3$ |
| 6 | $-(CH_2)_4C_6H_{11}$ | $OCH_3$ | $OCH_3$ |
| 7 | $-CH_2C_6H_5$ | $OCH_3$ | $OCH_3$ |
| 8 | $-CH_2C(CH_3)_3$ | $OCH_3$ | $OCH_3$ |
| 9 | $-CH_2CH(CH_3)CH_2C(CH_3)_3$ | $OCH_3$ | $OCH_3$ |
| 10 | $-CH_2C_5H_9$ | $OCH_3$ | $OCH_3$ |
| 11 | $-CH_3$ | $OCH_3$ | $OCH_3$ |

Equivalent samples were made of some of the dyes in which the poly(vinylidene chloride/vinyl chloride) copolymer was replaced with poly(vinyl butyral).

The films were conventionally imaged and thermally developed then exposed to 2000 foot candles (# lumens) of fluorscent light at 60% relative humidity for indicated lengths of time. The results are reported below in Table 1.

TABLE 1

| | Dmax | | | | Dmin | | |
|---|---|---|---|---|---|---|---|
| Dye | 0 hrs | 6 hrs | 16 hrs | % Fade | 0 hrs | 6 hrs | 16 hrs |
| A | 2.35 | 1.45 | — | 38% | 0.13 | 0.27 | — |
| B | 1.24 | 1.15 | — | 7% | 0.53 | 0.51 | — |
| 1 | 2.00 | 1.71 | — | 14.5% | 0.10 | 0.25 | — |
| 2 | 2.03 | 1.80 | — | 11% | 0.10 | 0.24 | — |
| 3 | 2.13 | — | 1.84 | 13% | 0.14 | — | 0.22 |
| 4 | 2.36 | — | 2.26 | 4% | 0.14 | — | 0.22 |
| 5 | 2.03 | — | 1.31 | 35% | 0.13 | — | 0.21 |
| 6 | 2.07 | — | 1.97 | 4% | 0.13 | — | 0.22 |
| 7 | 1.62 | — | 1.23 | 24% | 0.13 | — | 0.21 |
| 8 | 2.10 | — | 2.00 | 4% | 0.14 | — | 0.24 |
| 9 | 2.33 | 2.16 | — | 7% | 0.12 | 0.30 | — |
| 10 | 1.93 | 1.74 | — | 9% | 0.13 | 0.21 | — |
| 11 | 1.41 | 1.19 | — | 15% | 0.08 | 0.74 | — |

The increased stability of the dyes with the at least 2 carbon atom R groups can be seen by the Examples. Although the methyl counterpart with $R^1$ and $R^2$ as methoxy had increased stability, its Dmax and Dmin were totally unacceptable for consideration as a useful dye former.

EXAMPLES 12–15

These Examples show the increased stability of the at least 2 carbon atom R group dyes even without the stabilizing resin as compared to syringaldazine. The resin binder component comprised only poly(vinyl butyral).

| | | Dmax | | | Dmin | |
|---|---|---|---|---|---|---|
| Example | Dye | 0 hrs | 16 hrs | % Fade | 0 hrs | 16 hrs |
| 12 | 3 | 2.45 | 1.71 | 30% | 0.14 | 0.27 |
| 13 | 8 | 2.63 | 2.35 | 10% | 0.14 | 0.27 |
| 14 | 6 | 2.57 | 2.43 | 5% | 0.13 | 0.30 |
| 15 | 4 | 2.25 | 1.73 | 23% | 0.13 | 0.30 |

What is claimed is:

1. A photothermographic emulsion capable of producing an image having visible color therein upon exposure to actinic radiation and thermal development said emulsion comprising a binder, an organic silver salt, silver halide in catalytic proximity to said organic silver salt, and a dye forming developer in reactive association with said organic silver salt, said emulsion being characterized by the fact that said developer comprises a compound of the formula

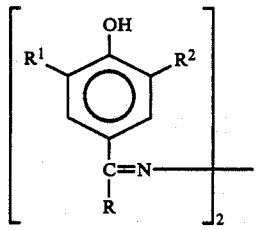

wherein R is an alkyl of at least 2 carbon atoms, alkylaryl or alkylcycloalkyl group, and $R^1$ and $R^2$ are independently selected from H (with no more than 1 of $R^1$ and $R^2$ equal to H), alkyl, alkoxy, aryl, and heterocyclic groups, and wherein said binder contains a dye stabilizing amount of a resin selected from the class of poly(vinyl chloride), poly(vinylidene chloride), and copolymers thereof.

2. The emulsion of claim 1 wherein $R^1$ and $R^2$ comprise alkyl groups.

3. The emulsion of claim 2 wherein $R^1$ and $R^2$ are branched chain alkyl groups.

4. The emulsion of claim 1 wherein $R^1$ and $R^2$ are alkoxy.

5. The emulsion of claim 1 wherein R is an alkyl of at least 2 carbon atoms.

6. The emulsion of claim 3 wherein R is an alkyl of a least 2 carbon atoms.

7. The emulsion of claim 4 wherein R is an alkyl of at least 2 carbon atoms.

8. The emulsion of claim 1 wherein R is a branched alkyl group.

9. The emulsion of claim 3 wherein R is a branched alkyl group.

10. The emulsion of claim 4 wherein R is a branched alkyl group.

11. A color photothermographic element comprising the emulsion of claim 1 on a substrate.

12. A color photothermographic element comprising the emulsion of claim 3 on a substrate.

13. A color photothermographic element comprising the emulsion of claim 4 on a substrate.

14. A color photothermographic element comprising the emulsion of claim 6 on a substrate.

15. A color photothermographic element comprising the emulsion of claim 10 on a substrate.

16. The color photothermographic element of claim 11 further comprising at least one more color forming photothermographic emulsion layer capable of producing a color different from that produced by said color forming developer.

17. The color photothermographic element of claim 12 further comprising at least one more color forming photothermographic emulsion layer capable of producing a color different from that produced by said color forming developer.

18. The color photothermographic element of claim 13 further comprising at least one mor color forming photothermographic emulsion layer capable of producing a color different from that produced by said color forming developer.

19. The color photothermographic element of claim 14 further comprising at least one more color forming photothermographic emulsion layer capable of producing a color different from that produced by said color forming developer.

20. The color photothermographic element of claim 15 further comprising at least one more color forming photothermographic emulsion layer capable of producing a color different from that produced by said color forming developer.

* * * * *

UNITED STATES PATENT AND TRADEMARK OFFICE

CERTIFICATE OF CORRECTION

PATENT NO. : 4,795,697

DATED : January 3, 1989

INVENTOR(S) : Vogel, Weigel and Mader

It is certified that error appears in the above-identified patent and that said Letters Patent is hereby corrected as shown below:

Column 3, line 6 "oo" should be --to--.

Claim 18, column 7, line 12 "mor" should be --more--.

Column 1, line 22, "iinclude" should be --include--.

Column 4, line 51, "ilver" should be --silver--.

Signed and Sealed this

Fourteenth Day of November, 1989

*Attest:*

JEFFREY M. SAMUELS

*Attesting Officer* *Acting Commissioner of Patents and Trademarks*